US005188171A

United States Patent [19]

Stefanov et al.

[11] Patent Number: 5,188,171

[45] Date of Patent: Feb. 23, 1993

[54] LIQUID-CRYSTAL HEAT VALVE CONTROLLED WITH MULTIPLE ELECTRODE PAIRS

[75] Inventors: Michael E. Stefanov, Lynn Haven, Fla.; Rand R. Biggers, Fairborn, Ohio; Jeff W. Rish, III, Lynn Haven, Fla.; Girardeau L. Henderson; Chuong N. Pham, both of Panama City, Fla.

[73] Assignee: The United States of America as represented by the Secretary of the Navy, Washington, D.C.

[21] Appl. No.: 902,201

[22] Filed: Jun. 22, 1992

[51] Int. Cl.[5] ..... F28F 13/00

[52] U.S. Cl. ..... 165/96; 165/32

[58] Field of Search ..... 165/32, 96

[56] References Cited

U.S. PATENT DOCUMENTS

| | | | |
|---|---|---|---|
| 3,374,830 | 3/1968 | O'Sullivan, Jr. | 165/96 |
| 3,448,791 | 6/1969 | Clark | 165/96 |
| 3,841,107 | 10/1974 | Clark | 165/96 |
| 4,742,867 | 5/1988 | Walsh | 165/96 |

*Primary Examiner*—Albert W. Davis, Jr.

*Attorney, Agent, or Firm*—K. W. Dobyns; W. C. Townsend

[57] ABSTRACT

A liquid-crystal heat valve is constructed to be controlled with multiple electrode pairs. So constructed, it is controllable by alternating electric potentials in different phases applied to corresponding electrode pairs, thus increasing the maximum heat-transfer rate of the heat valve by increasing its duty cycle.

3 Claims, 1 Drawing Sheet

LIQUID-CRYSTAL HEAT VALVE CONTROLLED WITH MULTIPLE ELECTRODE PAIRS

GOVERNMENT INTEREST STATEMENT

The invention described herein may be manufactured and used by or for the Government of the United States of America for government purposes without the payment of any royalties thereon.

BACKGROUND OF THE INVENTION

1. Field of the Invention

This invention relates to ân improved liquid-crystal heat valve for actively controlling and regulating heat transfer between two bodies. The invention has various potential applications. The application of most interest to the inventors is used in connection with free-swimming oceanic divers' garments, for control of the flow of heat between a diver and the ambient water. Four of the present inventors are among the five in U.S. patent application Ser. No. 07/888,096 filed May 26, 1992, for a heat-valve system suitable for use with divers' garments for control of heat flow. This prior application is assigned to a common assignee with the present application, and reference is made thereto for relevant background information. The present invention represents a significant improvement to that approach.

2. Description of the Prior Art

U.S. Pat. No. 4,515,206 to Edward F. Carr documents the occurrence of anomalous ordering and alignment effects ôf liquid-crystal fluids in the presence of electric and magnetic fields. Reference is made to the Carr patent for much relevant background information.

OBJECTIVES OF THE INVENTION

The object of the present invention is to increase the heat-transfer efficiency of liquid-crystal heat valves by increasing the duty cycle during which such transfer is most efficiently carried out.

Another object of the present invention is to provide multiple electrode pairs which can be used to apply electric fields in a rotating phase pattern, thereby to provide a substantially continuous large electric field in the liquid crystal which rotates around the crystal in sync with the electric signal applied to the different electrode pairs.

DETAILED DESCRIPTION OF THE PREFERRED EMBODIMENT

Figure 1A:
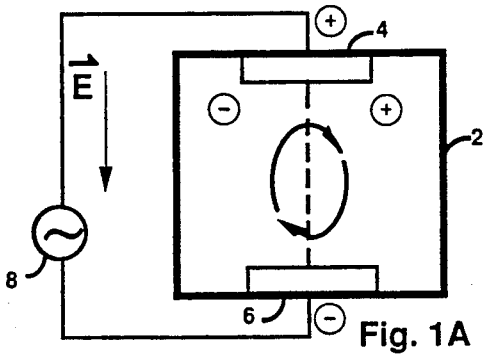
Fig. 1A (PRIOR ART)
FIGS. 1A and 1B show a liquid crystal having only one pair of electrodes, and the effect at different times of applying an electric signal to the single pair.
Figure 1B:
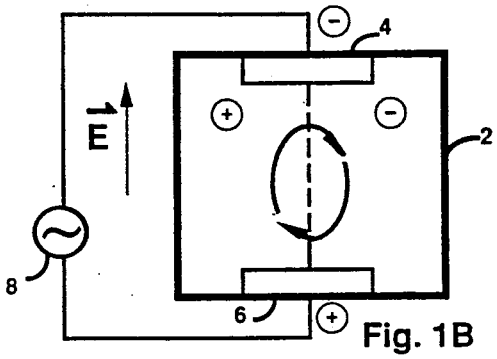
Fig. 1B (PRIOR ART)

FIGS. 1A and 1B are schematic views of a simple two electrode liquid-crystal heat valve from the prior art. Valves of this general type might have been used in connection with our prior application. The heat transport capabilities of the liquid-crystal based heat valves are enhanced by the convective nature of the electrically induced flow cells established within the liquid-crystal fluid in the heat valve. There are certain physical parameters that dictate the efficiency of the heat flux from the high temperature surface to the lower temperature surface and thus the overall amount of thermal energy moved from one surface to the other. Optimizing the size and extent of the flow cell comprised by the liquid-crystal heat valve from one surface to the other and the particle velocity within the cell helps to control the performance of the liquid crystal features of the cell. In the configuration of FIGS. 1A and 1B, a liquid-crystal heat valve 2 has two electrodes 4 and 6 on opposing faces of the heat valve. The flow cell size and particle velocity within the heat valve are dictated by cell geometry and materials parameters.

A source 8 of alternating polarity voltage supplies an electric signal to be used in applying an alternating voltage field between electrodes 4 and 6, resulting in the appearance of an electric field $\bar{E}$ across the liquid crystal, which field is oriented in accordance with the electric signal applied to the electrodes. As discussed in our previous application, the use of an alternating field of controlled frequency across the crystal offers much more control of the heat flow than is obtainable with a unidirectional field. However, with only one pair of electrodes in use, the duty cycle of the field is not as long as it could be, and there are thus times when the field strength across the liquid crystal is zero.

The flow cell geometry and the particle velocity can be enhanced by the addition of additional electrode pairs as shown schematically in FIGS. 2A, 2B, 2C, and 2D, and the requisite electronic addressing. The major utility of the new configuration is being able to accelerate the material in full cycle rather than half. Also the flow cell size is no longer dominated by the weak elastic constant, but by the electronic addressing and timing configuration. Simply stated, the configuration of FIGS. 2A–2D offers the potential for a significant enhancement in the thermal transport properties of the liquid crystal heat valve through an enhancement in the efficiency of the materials moved from one surface to the other, and also for an increase in the flow velocity within the cell.

Figure 2A:
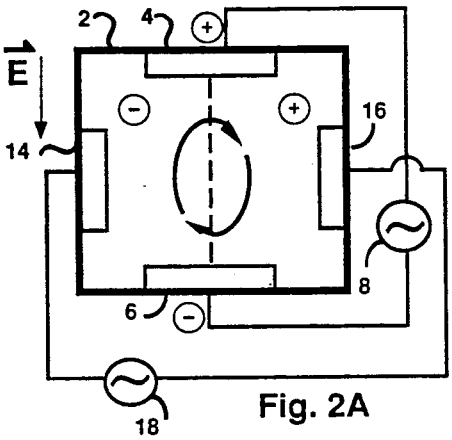
FIGS. 2A, 2B, 2C and 2D show a liquid crystal having two pairs of electrodes, and the effect at different times of applying electric signals in a rotating phase pattern to the two pairs.
Figure 2B:
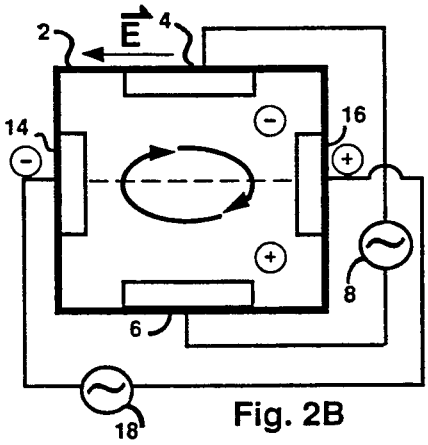
Figure 2C:
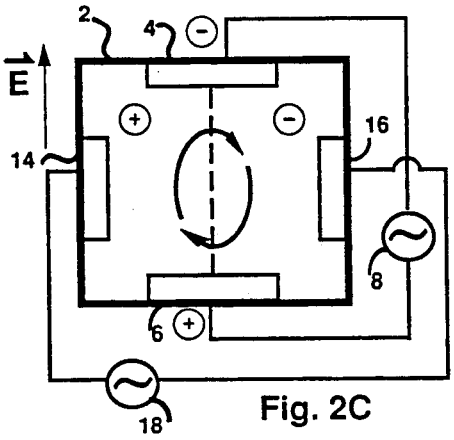
Figure 2D:
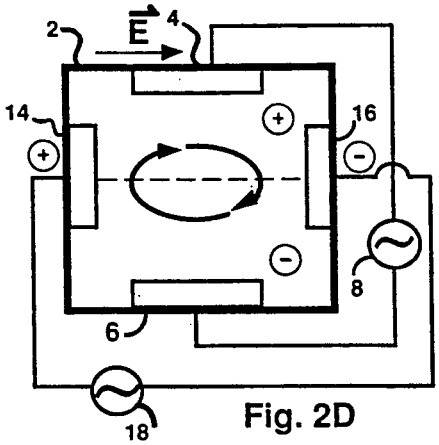

In FIGS. 2A through 2D, in addition to electrodes 4 and 6 applying a voltage to heat valve 2 from the source of alternating voltage 8, an additional set of electrodes 14 and 16 apply a second out-of-phase voltage from a source of alternating voltage 18 to the heat valve 2. Sources 8 and 18 are, for example, 90° out of phase with each other. The heat valve control would work reasonably well if sources 8 and 18 were anywhere from about 45° to about 135° out of phase with each other, but in a two-electrode-pair system, the optimum occurs when the two sources approach 90° out of phase with each other. In FIG. 2A, source applies a positive potential to electrode 4 and a negative potential to electrode 6, such as might occur at one of the peaks of a sinusoidal wave, while source 18 applies zero potential to both electrodes 14 and 16, such as might occur at the zero point of a sinusoidal wave. This results in an electric field $\bar{E}$ across the valve in a direction generally from electrode 4 to electrode 6. At a time 90° later in the wave forms, as shown in FIG. 2B, source 18 applies a positive potential to electrode 16 and a negative potential to electrode 14, while source 8 applies a zero potential to both electrodes 4 and 6. Thus, the electric field $\bar{E}$ has rotated 90° around the valve, and is aligned approximately from electrode 16 to electrode 14. At a time 90° later in the waveform, FIG. 2C shows that the electric field has rotated another 90° around the heat valve, followed by another 90° rotation in FIG. 2D. Then FIG. 2A repeats the cycle. By maintaining a rotating field, the system does not have times in which the field as a whole goes through zero, and the resulting heat conductivity is increased.

There is no inherent necessity of limiting the system to two pairs of electrodes, and more could be used, with the voltage being applied to the electrodes as a rotating phasor, much as is done in some rotating electric machinery, such as a.c. motors.

We claim:

1. An improved liquid crystal heat valve, comprising

A. a mass of liquid-crystal material situated in a liquid-crystal heat valve for control of heat flow through the valve, and B. a plurality of pairs of electrically separate electrodes arranged about the periphery of the mass of liquid-crystal material, and adapted to apply an electric field across the mass of liquid-crystal material in a plurality of directions.

2. A valve in accordance with claim 1, wherein said plurality of pairs comprises two pairs, and further comprising:

A. a first source of alternating polarity electric potential for applying an alternating potential to a first of said two pairs of electrodes, and B. a second source of alternating polarity electric potential which is between 45° and 135° out of phase with said first source, for applying an alternating potential to a second of said two pairs of electrodes.

3. A valve in accordance with claim 1, wherein said plurality of pairs comprises two pairs, and further comprising:

A. a first source of alternating polarity electrode potential for applying an alternating potential to a first of said two pairs of electrodes, and B. a second source of alternating polarity electric potential which is approximately 90° out of phase with said first source, for applying an alternating potential to a second of said two pairs of electrodes.

* * * * *